US006508570B1

(12) United States Patent
Tseng

(10) Patent No.: US 6,508,570 B1
(45) Date of Patent: Jan. 21, 2003

(54) DECORATIVE LAMP

(76) Inventor: Jeou-Nan Tseng, No. 539, Sec. 4, Chunghua Rd., Hsinchu (TW)

( * ) Notice: Subject to any disclaimer, the term of this patent is extended or adjusted under 35 U.S.C. 154(b) by 0 days.

(21) Appl. No.: 09/921,594

(22) Filed: Aug. 6, 2001

(51) Int. Cl.[7] ..... F21V 21/30

(52) U.S. Cl. ..... 362/227; 362/249; 362/252; 362/806

(58) Field of Search ..... 362/252, 249, 362/152, 396, 806

(56) References Cited

U.S. PATENT DOCUMENTS 1,702,028 A * 2/1929 Blanchard ..... 362/249
4,462,065 A * 6/1984 Rhodes ..... 362/250
4,866,581 A * 9/1989 Targetti ..... 362/249
5,645,343 A * 7/1997 Rinehimer ..... 362/252
5,876,111 A * 3/1999 Wu ..... 362/250
5,993,025 A * 11/1999 Huang ..... 362/249
6,056,418 A * 5/2000 Hsu ..... 362/249
6,183,110 B1 * 2/2001 Chang ..... 362/249
6,302,560 B1 * 10/2001 Iai ..... 362/249
6,196,700 B1 * 9/2002 Lai ..... 362/249

* cited by examiner

*Primary Examiner*—Sandra O'Shea
*Assistant Examiner*—Anabel Ton
(74) *Attorney, Agent, or Firm*—Rabin & Berdo, P.C.

(57) ABSTRACT

A decorative lamp has a base having two ends wherefrom a first arcuate rod and a second arcuate rod integrally and respectively extend to interact to each other. A first post is connected between a first free end of the first arcuate rod and one end of the base. A second post is connected between a first free end of the second arcuate rod and the other end of the base. A plurality of bulbs is assembled on the base, the first arcuate rod and the second arcuate.

11 Claims, 9 Drawing Sheets

DECORATIVE LAMP

BACKGROUND OF THE INVENTION

1. Field of the Invention

The present invention is related to a decorative lamp, and more particularly to a decorative lamp that is convenient to be decorated and stored.

2. Description of Related Art

At festivals and other special occasions, decorative lamps are widely used ornaments. Conventional decorative lamps, which are composed of lamps that are arranged on electric wires, generally cover or are twisted on something that needs to be decorated. Hence, it is very inconvenient for a user to set up these decorative lamps. Moreover, it is also difficult to store the decorative lamps.

Therefore, the invention provides a decorative lamp to mitigate and/or obviate the aforementioned problems.

SUMMARY OF THE INVENTION

The main objective of the invention is to provide a decorative lamp that is easy to be set up and stored.

Other objects, advantages and novel features of the invention will become more apparent from the following detailed description when taken in conjunction with the accompanying drawings.

DETAILED DESCRIPTION OF THE PREFERRED EMBODIMENT

Figure 1:
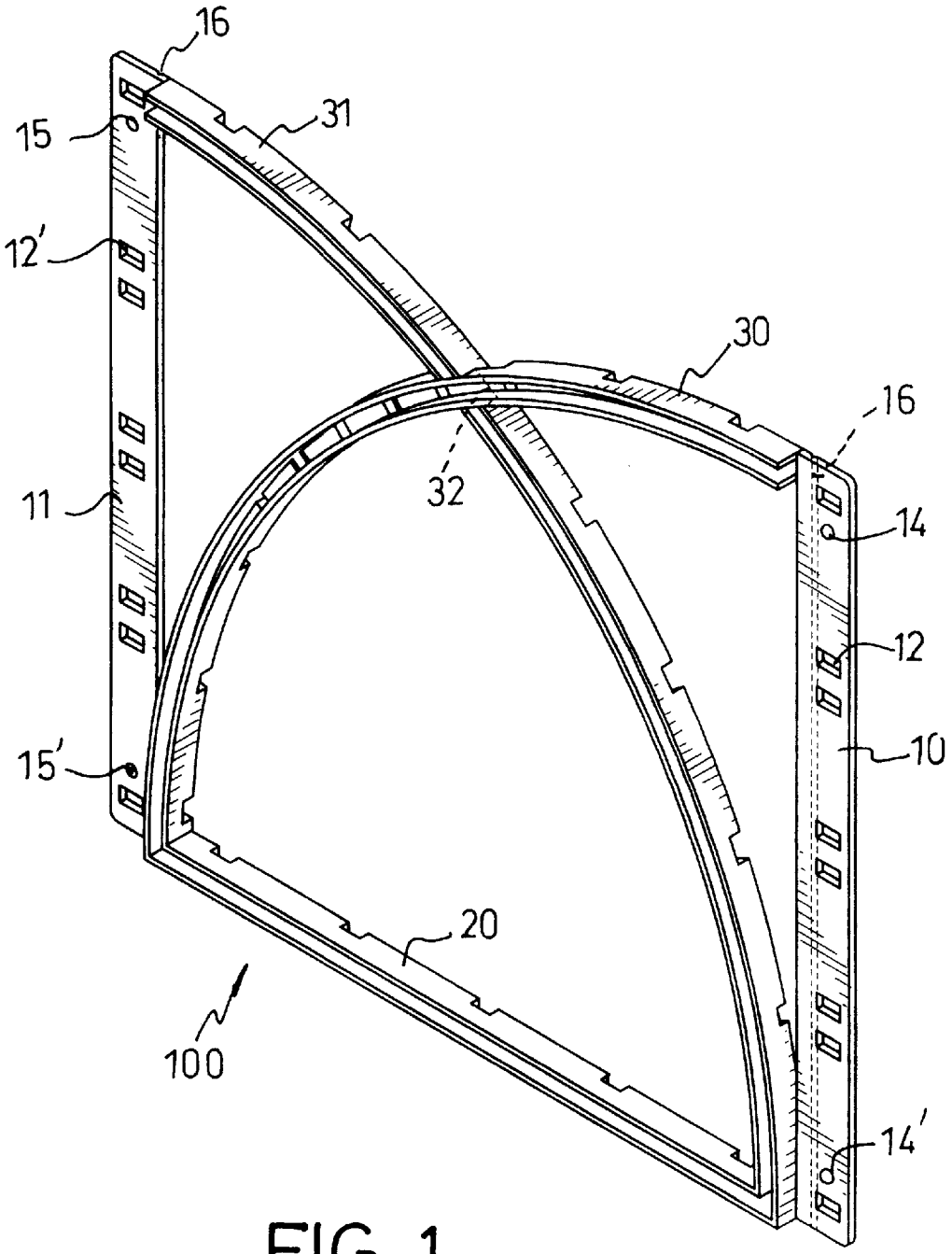
FIG. 1 is a perspective view of a decorative lamp in accordance with the invention.

With reference to FIG. 1, a decorative lamp in accordance with the present invention is composed of a U-shaped bar (100) having a lateral base (20) with a first and a second upright posts (10, 11) formed at respective ends of the base (20). A top end of each post (10, 11) has an arcuate rod (30, 31) extending downward therefrom to join with the opposed end of the base (20), whereby the arcuate rods (30, 31) intersect each other. A notch (32) is defined in one of the two arcuate rods (30, 31) to engage with the other arcuate rod (30, 31). Each of the two posts (10, 11) is defined with a plurality of paired openings (12, 12'). Two pins (14, 14') and two apertures (15, 15') are respectively provided at the first post (10) and the second post (11). Furthermore, the two posts (10, 11) each have a groove (16) longitudinally defined therein.

Figure 2:
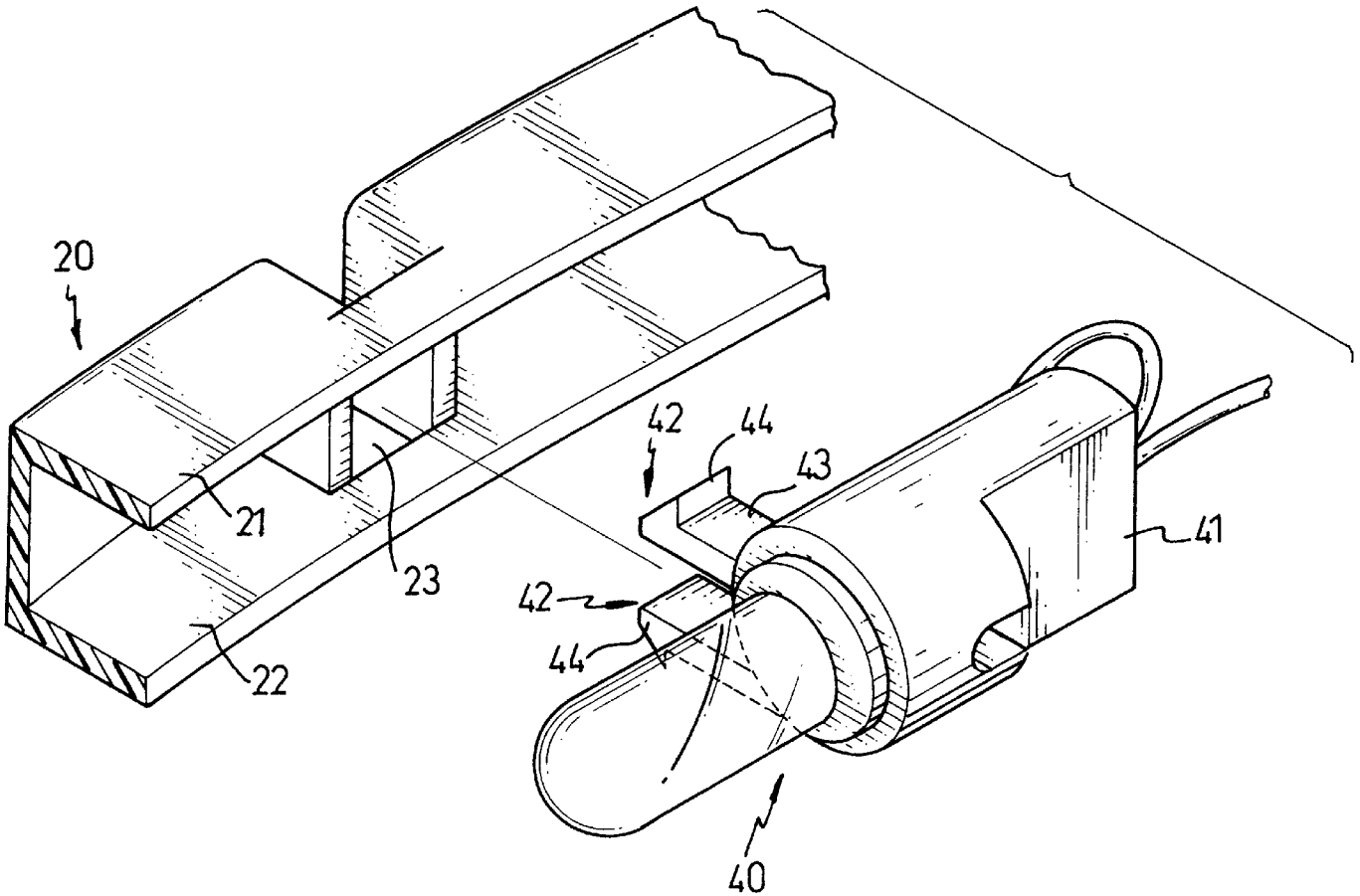
FIG. 2 is an exploded perspective view showing a bulb supported by a bulb-holder being arranged in the base in accordance with the invention.
Figure 3:
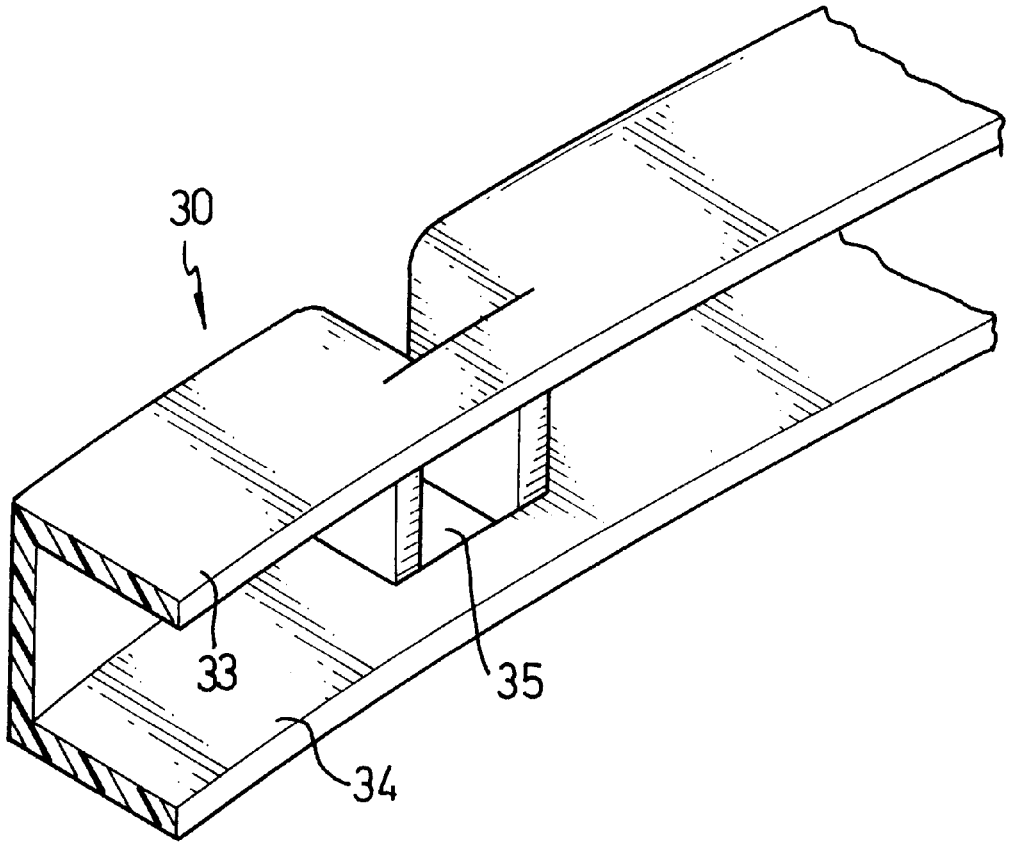
FIG. 3 is an partial cross-sectional view of an arcuate rod in accordance with the present invention.

With reference to FIGS. 2 and 3, the cross-section view of each of the bar (20) and the two rods (30,31) is substantially C-shaped and each may receive at least one bulb (40). With reference to FIG. 2, the bar (20) has a U-like cross-section with two parallel lateral parts (21,22) and an upright part (not numbered) extending between the lateral parts (21,22). A plurality of slots (23) is defined in the base (20), and the slots (23) are evenly spaced apart. With reference to FIG. 3, the structures of the two rods (30,31) and the base (20) are substantially the same. The rod (30) has a U-like cross-section with two parallel lateral parts (33,34) and an upright part (not numbered) extending between the lateral parts (33,34). A plurality of slots (35) is defined in the rod (30).

Figure 4:
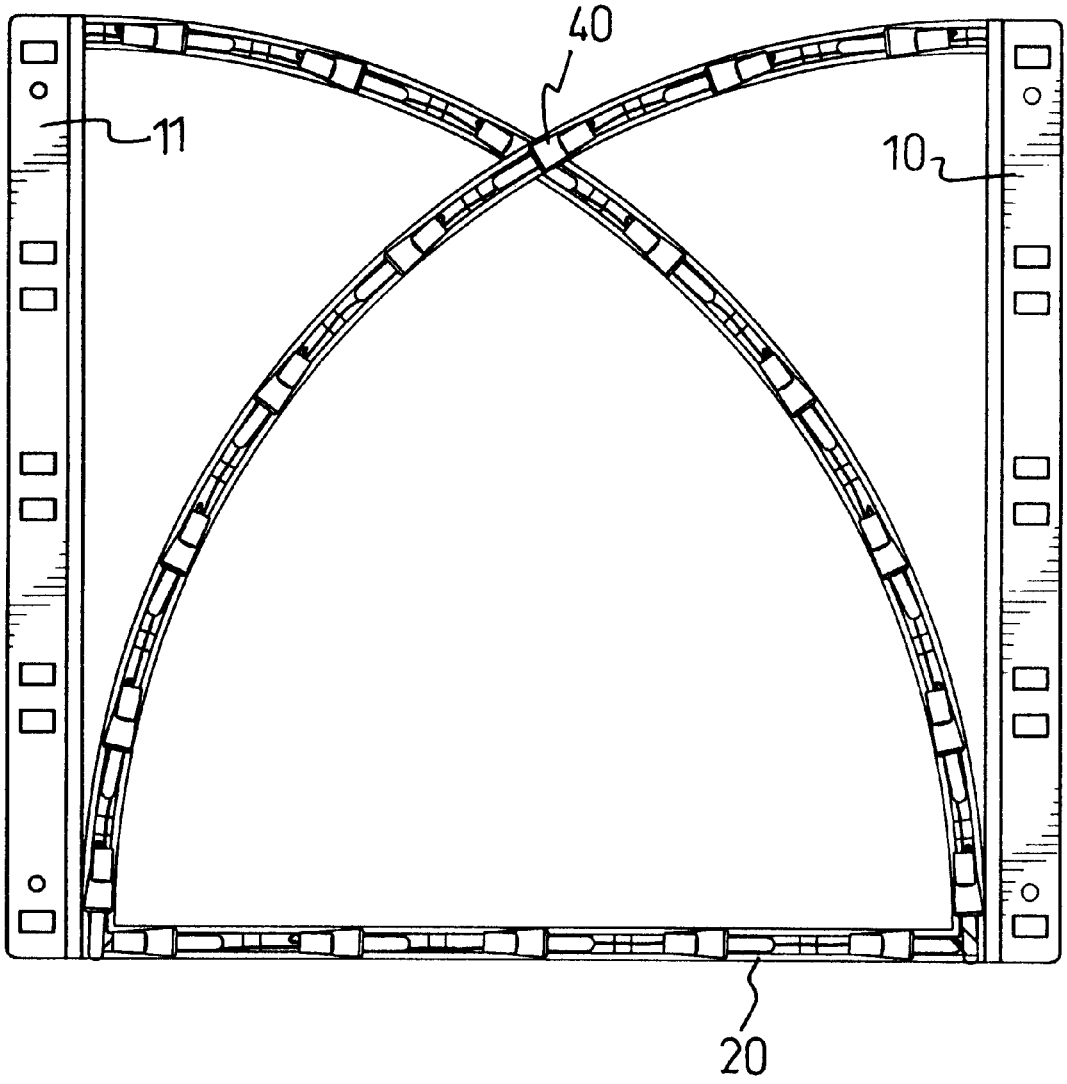
FIG. 4 is a plan view showing a plurality of bulbs arranged on bars in accordance with the present invention.

The bulb (40) has a bulb-holder (41) that has two tongues (42) extending outwards and fastened in the respective slot (23). The tongues (42) each have a finger (43) with a barb (44) formed at a distal tip of each finger (43). A wire extends through between the fingers (43), and the barbs (44) are inserted in the slot (23) and engaged in the lateral parts (21, 22) to prevent the bulb-holder (41) undesirably disengaging from the bar (20). FIG. 4 shows a plan view wherein multiple bulbs (40) are arranged on the bar (20) and the rods (30, 31).

The detailed structure of the decorative lamp in accordance with the present invention is clearly described, and the application of the decorative lamp will be clearly described below.

Figure 5:
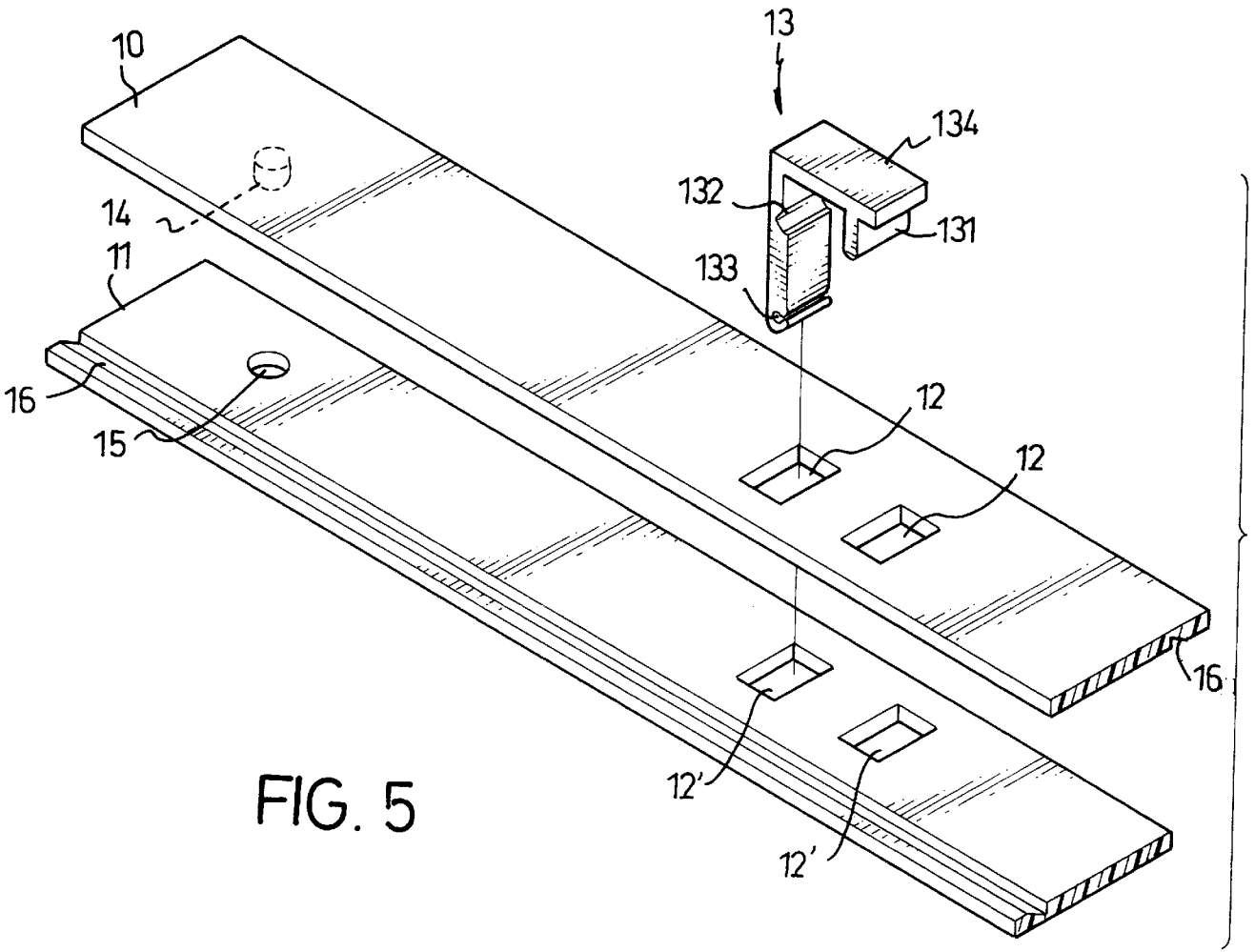
FIG. 5 is an exploded perspective view of posts of the decorative lamp in accordance with the invention.
Figure 6:
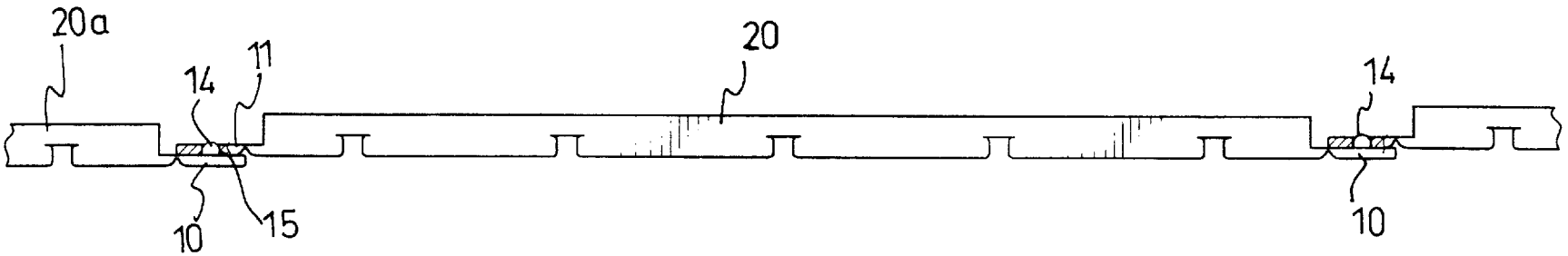
FIG. 6 is a bottom plan view showing multiple decorative lamps in accordance with the invention being connected in series.
Figure 7:
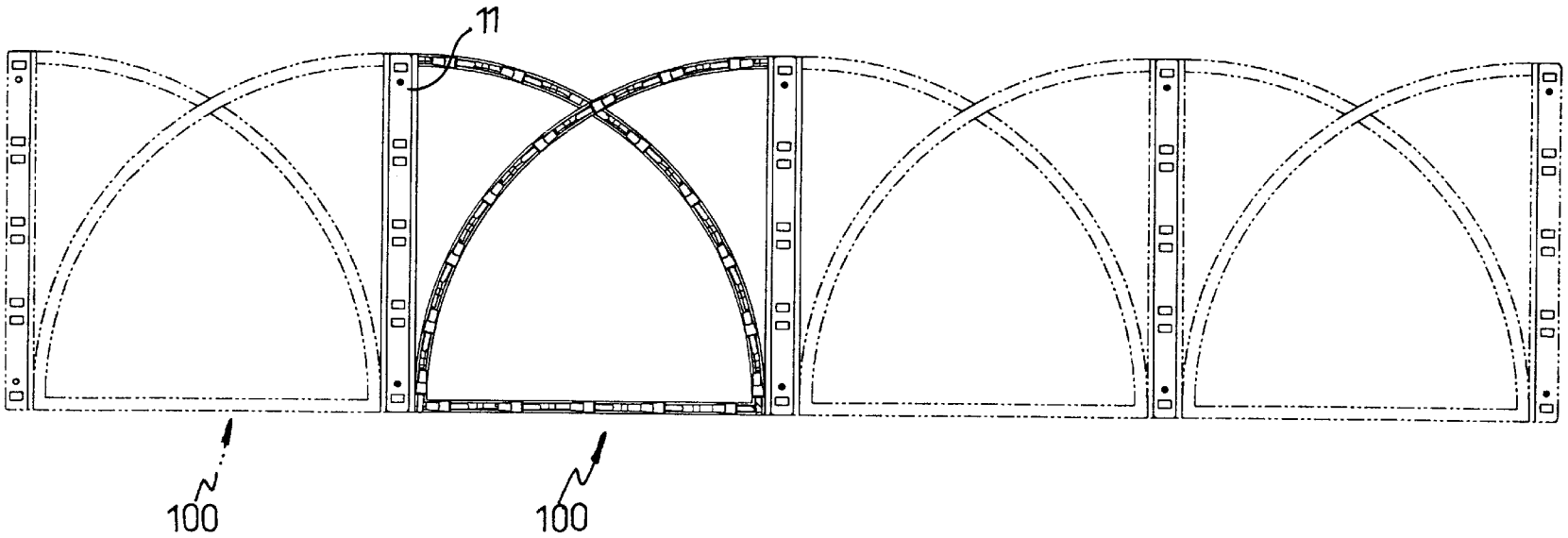
FIG. 7 is a perspective plan view showing multiple decorative lamps in accordance with the invention being connected in series.

With reference to FIGS. 5, 6 and 7, multiple decorative lamps in accordance with the present invention are connected in series. In FIG. 5, two decorative lamps each respectively provides the first post (10) and the second post (11) to connect two decorative lamps. The openings (12) of first post (10) are in alignment with the openings (12') of the second post (11), and a plurality of fasteners (13) is respectively inserted through the openings (12, 12') and secured therein to assemble the two posts (10, 11) together. Simultaneously, the pins (14) of the first post (10) are received in the apertures (15) of the second post (11).

The fasteners (13) are each substantially formed as an inverted "J" with a long leg (not numbered) with a pivot notch (132) defined therein, a short leg (131) and a central portion (134), wherein the long leg has a C-like channel (133) defined at a free end thereof to engage with the short leg (131) when bent inwards about the pivot notch (132). Each long leg is configured to be extendable through mated openings (12, 12') and then deformed about the pivot notch (132), and the short leg (131) is simultaneously fed through mated openings (12, 12') to engage with the C-like channel (133). Thus, the decorative lamps are securely assembled together by the fasteners (13).

With reference to FIG. 6, a bottom plan view of two decorative lamps in accordance with the present invention connected in series is shown, wherein each pin (14) is in alignment with and received in the respective aperture (15).

With reference to FIG. 7, a perspective plan view of multiple decorative lamps in accordance with the invention connected in series is shown, wherein the multiple decorative lamps is configured form a decorative lamp fence.

Figure 8:
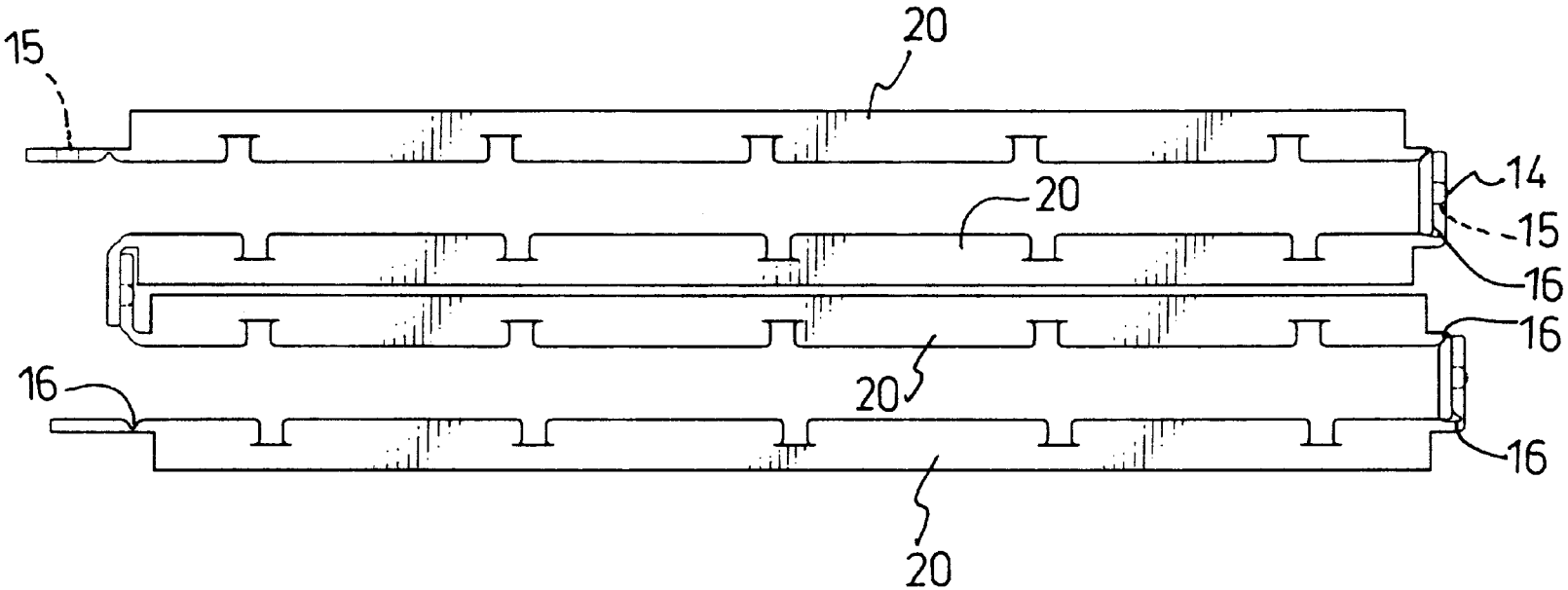
FIG. 8 is a schematic view showing multiple connected decorative lamps in accordance with the invention being folded for storage.

With reference to FIG. 8, a bottom plan view shows multiple decorative lamps connected in series can be folded along the grooves (16) in the posts (10, 11) for being stored. Thus, the assembled decorative lamp is convenient to be stored, and only occupies a little space.

Figure 9:
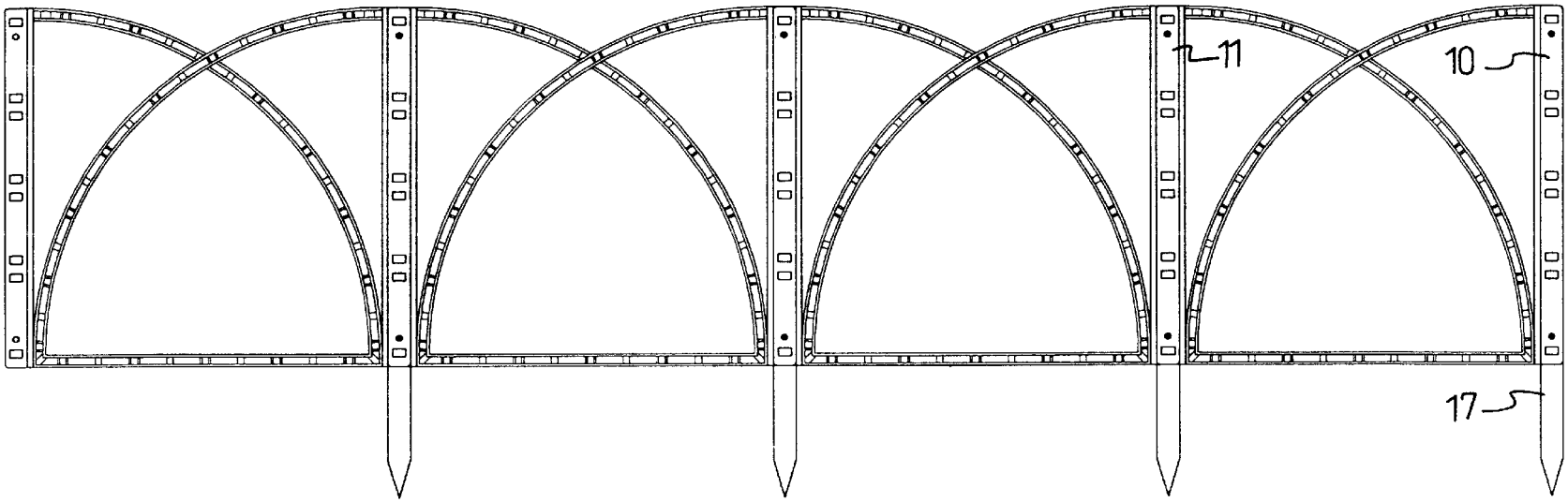
FIG. 9 is a perspective plan view showing multiple decorative lamps with support legs in accordance with the invention being connected in series.

With reference to FIG. 9, the first post (10) and the second post (11) further have supporting legs (17) connected therewith for inserting into the ground, such as a lawn, so as to steadily support the decorative lamp.

From the above description, it is noted that the invention has the following advantages:

1. It is very convenient for a user to set up the decorative lamp; and

2. The decorative lamp can be folded for storing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative lamp comprising:

a U-shaped bar (100) having a lateral base (20) with a first post (10) and a second post (11) respectively formed at opposed ends of the lateral base (20), wherein a first arcuate rod (30) and a second arcuate rod (31) respectively forms at a top end of each first and second post (10, 11) and extends downward to join with opposed ends of the lateral base (20), whereby the first arcuate rod (30) and the second arcuate rod (31) intersect each other; and a plurality of bulbs (40) assembled on the lateral base (20), the first and the second posts (10,11);

wherein the lateral base (20), the first and the second arcuate rods (30, 31) each has a U-shaped cross-section with two lateral parts (21, 22, 33, 34) and an upright part formed between the two lateral parts (21, 22, 33, 34), and a plurality of slots (23, 35) evenly spaced apart in the lateral base (20), the first and the second arcuate rods (30, 31).

2. The decorative lamp as claimed in claim 1, wherein the first arcuate rod (30) is defined with a notch (32) to receive the second arcuate rod (31) so as to position the second arcuate rod (31) relative to the first arcuate rod (30).

3. The decorative lamp as claimed in claim 2, wherein a plurality of paired openings (12, 12') is defined in the first and second posts (10, 11) so that when multiple decorative lamps are connected in series and the first post (10) and second post (11) are superposed with each other, the paired openings (12) of the first post (10) and the paired openings (12') of the second post (11) are aligned so as to receive a fastener (13) to secure the superposed first and second posts (10, 11).

4. The decorative lamp as claimed in claim 2, wherein at least one pin (14) is formed on the first post (10), and at least one aperture (15) is defined in the second post (11) to correspond to the at least one pin (14) so that when multiple decorative lamps are connected in series and the first post (10) and second post (11) are superposed with each other, the at least one pin (14) of the first post (10) is able to be inserted into the at least one aperture (15) of the second post (11) to secure the superposed first and second posts (10, 11).

5. The decorative lamp as claimed in claim 3, wherein at least one pin (14) is formed on the first post (10), and at least one aperture (15) is defined in the second post (11) to correspond to the at least one pin (14) so that when multiple decorative lamps are connected in series and the first post (10) and second post (11) are superposed with each other, the at least one pin (14) of the first post (10) is able to be inserted into the at least one aperture (15) of the second post (11) to secure the superposed first and second posts (10, 11).

6. The decorative lamp as claimed in claim 4, wherein two grooves (16) are respectively and longitudinally defined in the first post (10) and the second post (11) so that when multiple decorative lamps are connected in series and secured with each other, the grooves (16) in the first and second posts (10, 11) facilitate the folding of the multiple decorative lamps.

7. The decorative lamp as claimed in claim 5, wherein two grooves (16) are respectively and longitudinally defined in the first post (10) and the second post (11) so that when multiple decorative lamps are connected in series and secured with each other, the grooves (16) in the first and second posts (10, 11) facilitate the folding of the multiple decorative lamps.

8. The decorative lamp as claimed in claim 6, wherein the first post (10) and the second post (11) respectively has a supporting leg (17) extending outward for supporting the decorative lamp.

9. The decorative lamp as claimed in claim 7, wherein the first post (10) and the second post (11) respectively has a supporting leg (17) extending outward for supporting the decorative lamp.

10. The decorative lamp as claimed in claim 8, wherein each fastener (13) is formed as an inverted "J" and provided with a resilient long leg and a short leg connected to the long leg (131) through a central portion (134), wherein the long leg has a C-like channel (133) defined at a free end of the long leg to correspond to the short leg;

when the long leg and the short leg are respectively inserted through the aligned openings of the first and second posts, the long leg is able to bent inwards to allow the C-like channel to receive the short leg.

11. The decorative lamp as claimed in claim 9, wherein each fastener(13) is formed as an inverted "J" and provided with a resilient long leg and a short leg connected to the long leg (131) through a central portion, wherein the long leg has a C-like channel (133) defined at a free end of the long leg to correspond to the short leg;

when the long leg and the short leg are respectively inserted through the aligned openings of the first and second posts, the long leg is able to bent inwards to allow the C-like channel to receive the short leg.

* * * * *